US007878039B2

(12) United States Patent
Park et al.

(10) Patent No.: US 7,878,039 B2
(45) **Date of Patent: *Feb. 1, 2011**

(54) CHANNEL LETTER MACHINE AND METHOD THEREOF

(75) Inventors: Ju Woong Park, Shiheung-si (KR); Man Sik Cho, Shiheung-si (KR); Sang Moo Lee, Shiheung-si (KR); Byoung-Young Song, Old Tappan, NJ (US)

(73) Assignee: SDS USA, Inc., Northvale, NJ (US)

( * ) Notice: Subject to any disclaimer, the term of this patent is extended or adjusted under 35 U.S.C. 154(b) by 30 days.

This patent is subject to a terminal disclaimer.

(21) Appl. No.: 12/234,847

(22) Filed: Sep. 22, 2008

(65) Prior Publication Data

US 2009/0013747 A1 Jan. 15, 2009

Related U.S. Application Data

(63) Continuation of application No. 11/431,246, filed on May 9, 2006, now Pat. No. 7,441,434.

(51) Int. Cl.
*B21D 11/20* (2006.01)
*B21D 43/00* (2006.01)
*B21D 28/02* (2006.01)

(52) U.S. Cl. ..... 72/307; 72/428; 72/338

(58) Field of Classification Search ..... 72/14.8, 72/15.3, 16.1, 17.3, 18.2, 306, 307, 404, 72/405.01, 387, 129, 134, 420, 421, 428, 72/338

See application file for complete search history.

(56) References Cited

U.S. PATENT DOCUMENTS 5,461,893 A * 10/1995 Tyler ..... 72/16.2
5,881,591 A * 3/1999 Ondracek ..... 72/14.9
5,970,769 A * 10/1999 Lipari ..... 72/131

* cited by examiner

*Primary Examiner*—Debra M Sullivan
(74) *Attorney, Agent, or Firm*—F. Chau & Associates, LLC

(57) ABSTRACT

A channel letter bending machine for bending a return of a channel letter from a stock includes a feeding unit disposed along a path of travel of the stock to be bent for feeding the stock, a flanging unit for forming a flange along one edge of the stock, a notching unit for notching the flange of the stock fed by the feeding mechanism along the path of travel, and a bending unit for bending the stock under the control of the computer control system into the desired configuration for the channel letter shape, wherein the notching unit and the flanging unit are disposed upstream of the bending unit and the flanging unit is disposed upstream of the notching unit.

5 Claims, 12 Drawing Sheets

CHANNEL LETTER MACHINE AND METHOD THEREOF

CROSS-REFERENCE TO RELATED APPLICATIONS

This is a Continuation Application of U.S. application Ser. No. 11/431,246, filed on May 9, 2006, now U.S. Pat. No. 7,441,434 the disclosure of which is herein incorporated by reference in their entirety.

BACKGROUND OF THE INVENTION

1. Field of the Invention

The present disclosure relates to a folding and cutting system and method, and more particularly to a channel letter machine used for manufacturing a predetermined design from sheet material.

2. Description of Related Art

A channel letter includes a face, for example, made from a transparent material such as plastic or metal, and a back, for example, made of metal or plastic. The front face and back can be cut manually or cut using computer controlled routers. The channel letter further includes a return or side of the channel letter disposed to connect the front face and the back.

The return may be made of metal. The return is formed into the shape of the front face and back.

Therefore, a need exists for a channel letter machine for manufacturing the return of a channel letter.

SUMMARY OF THE INVENTION

According to an embodiment of the present disclosure, a computer-implemented method of automatically bending a return of a channel letter comprises inputting a desired configuration for the return to be formed into a control computer and feeding a stock under the control of the control computer along a feed path including a flanging unit, a notching unit, and a bending unit that are arranged along the feed path for the stock, with the flanging unit being located upstream of the notching unit and the bending unit along the feed path. The method further comprises forming a flange on the bottom of the stock at desired flange positions on the stock at the flanging unit under the control of the control computer, notching the flange of the stock at locations corresponding to a position of bends at the notching unit under the control of the control computer, and bending the stock at the positions of the bends into the desired configuration for the return at the bending unit under the control of the control computer.

According to an embodiment of the present disclosure, a channel letter bending machine for automatically bending a return of a channel letter from a stock comprises a control computer for receiving a desired configuration for the return of the channel letter, and a feeding unit controlled by the control computer disposed along a path of travel of the stock to be bent for feeding the stock. The channel letter bending machine further comprises a flanging unit disposed along the path of travel for forming a flange along one edge of the stock, a notching unit disposed along the path of travel for notching the flange of the stock fed by the feeding mechanism along the path of travel, and a bending unit disposed along the path of travel for bending the stock under the control of the computer control system into the desired configuration for the channel letter shape, wherein the flanging unit is disposed upstream of the notching unit.

BRIEF DESCRIPTION OF THE DRAWINGS

Preferred embodiments of the present invention will be described below in more detail, with reference to the accompanying drawings.

DETAILED DESCRIPTION OF PREFERRED EMBODIMENTS

According to an embodiment of the present disclosure, a channel letter machine for forming a return having a predetermined shape comprises a flanging assembly positioned upstream of a notching assembly and a bending assembly, facilitating efficient flanging of a stock by the flanging assembly without first notching the stock.

Figure 1A:
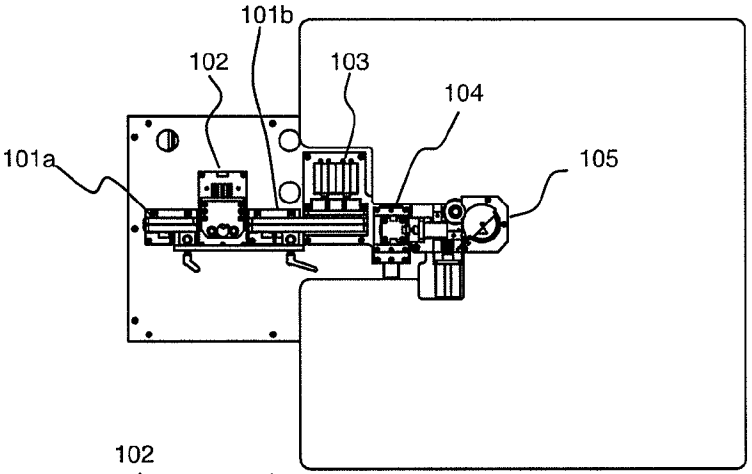
FIGS. 1A-C are diagrams of a channel letter machine according to an embodiment of the present disclosure.
Figure 1B:
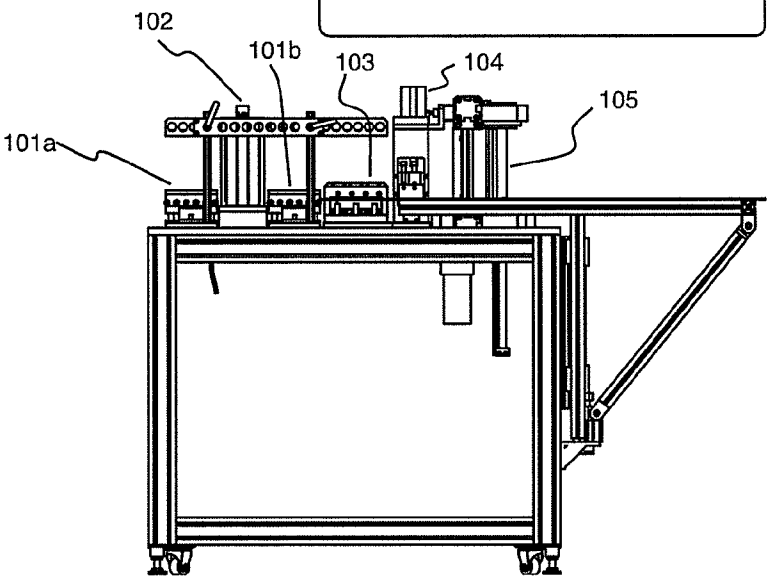
Figure 1C:
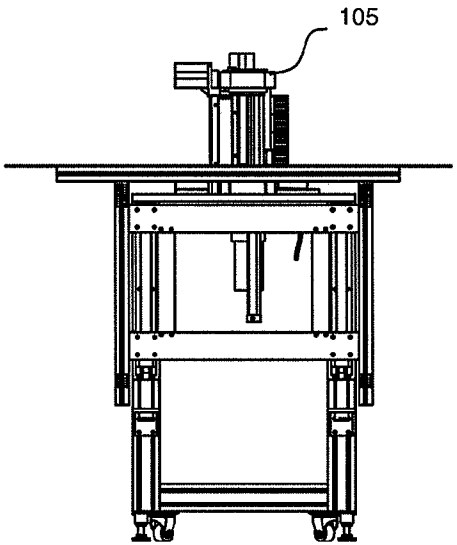

Referring to FIGS. 1A-C a channel letter machine comprises of guiding units 101*a*-101*b*, a feeding unit 102, a flanging unit 103 disposed upstream of a notching unit 104, and a bending unit 105. The channel letter machine further includes a control computer (not shown) for receiving commands for controlling the feeding unit 102, the flanging unit 103, the notching unit 104, and the bending unit 105.

The channel letter machine receives a stock material (hereinafter stock), e.g., a metal sheet material such as aluminum, and forms the return of a channel letter through flanging, notching, and bending operations.

Figure 2C:
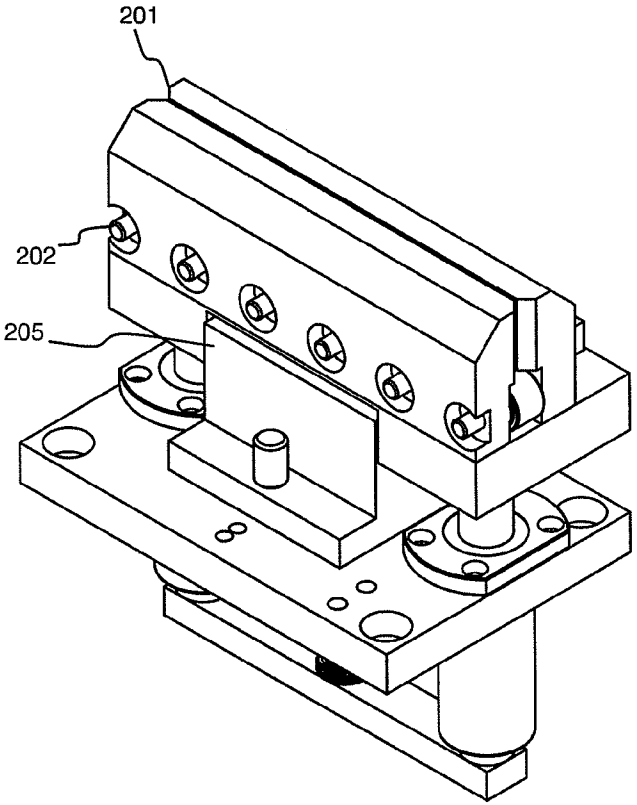
FIGS. 2A-D are diagrams of a guide of a channel letter machine according to an embodiment of the present disclosure.
Figure 2B:
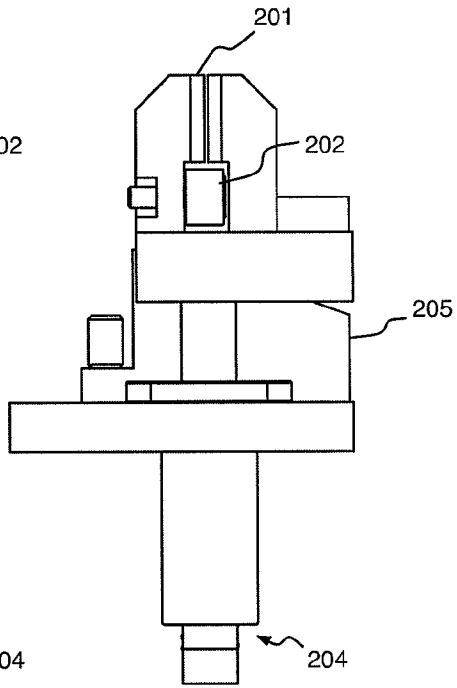
Figure 2A:
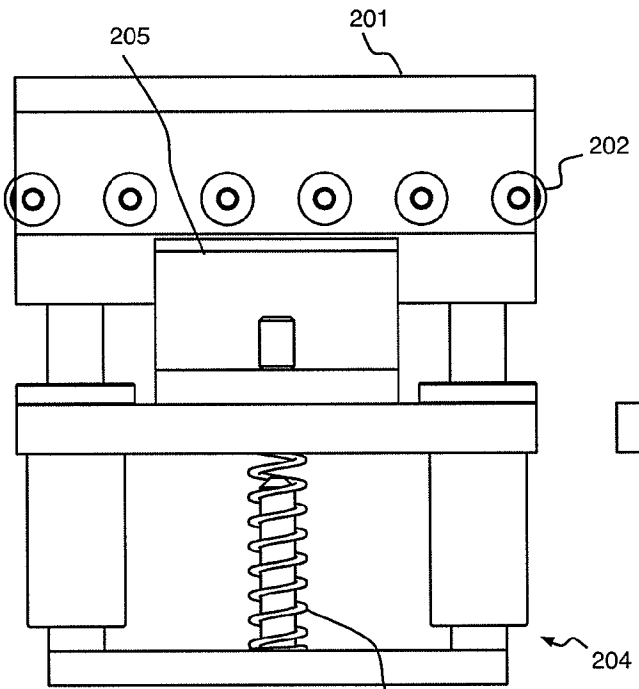
Figure 2D:
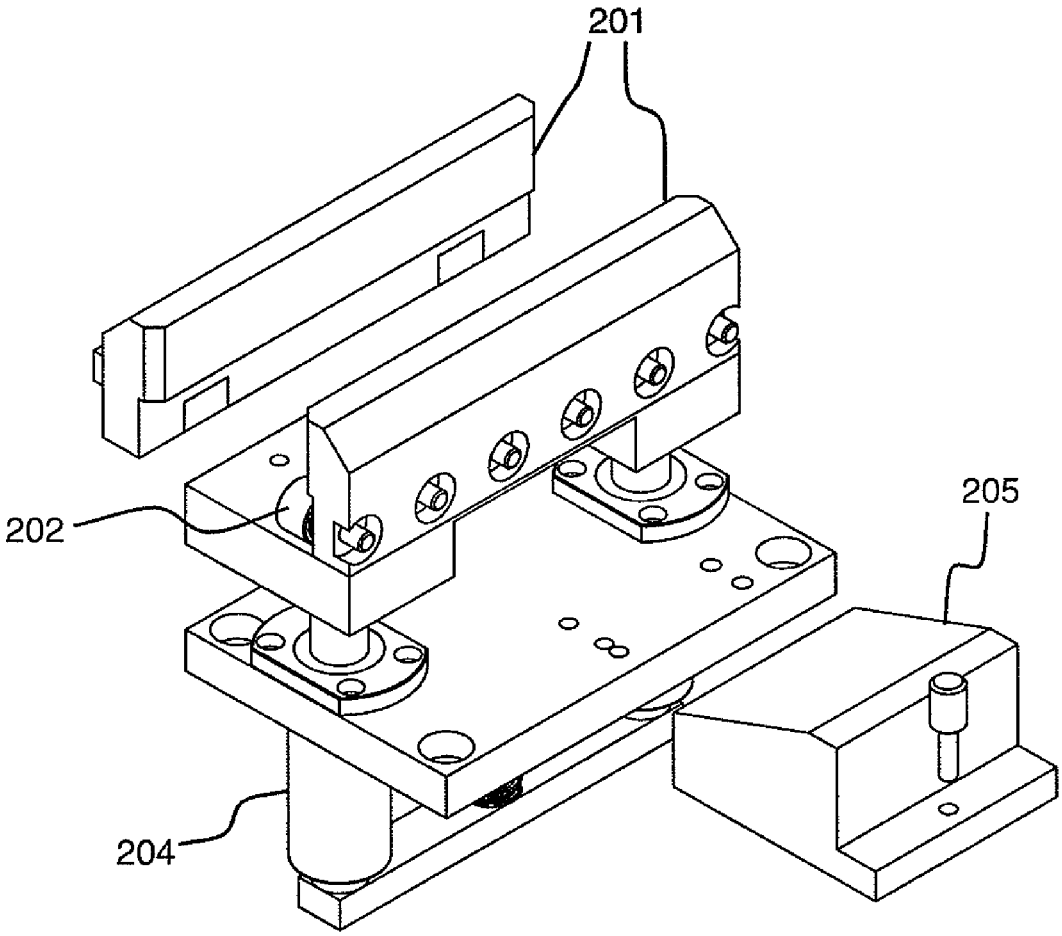

Referring to FIGS. 2A-C, the guiding units 101*a* and 101*b* each include a guide 201, guiding rollers 202, a shock absorber 203, and a height adjustment device 205. The guide 201 holds the stock upright for being received by the feeding unit 102, etc. The guide rollers 202 facilitate movement of the stock into the feeding unit 102 and the flanging unit 103. The guide 201, including the guiding rollers 202, is supported by the height adjustment device 205. The guiding unit 101 includes shafts 204 securing the guiding unit 101 in a horizontal position with respect to the channel letter machine. The guiding unit 101 may move in a vertical direction on the shafts 204, supported by the shock absorber 203 and the height adjustment device 205 (the shock absorber 203 and the height adjustment device 205 operated independently). The height adjustment device 205 adjusts the height of the guide 201, wherein a flanging depth or height can be adjusted.

Figure 3B:
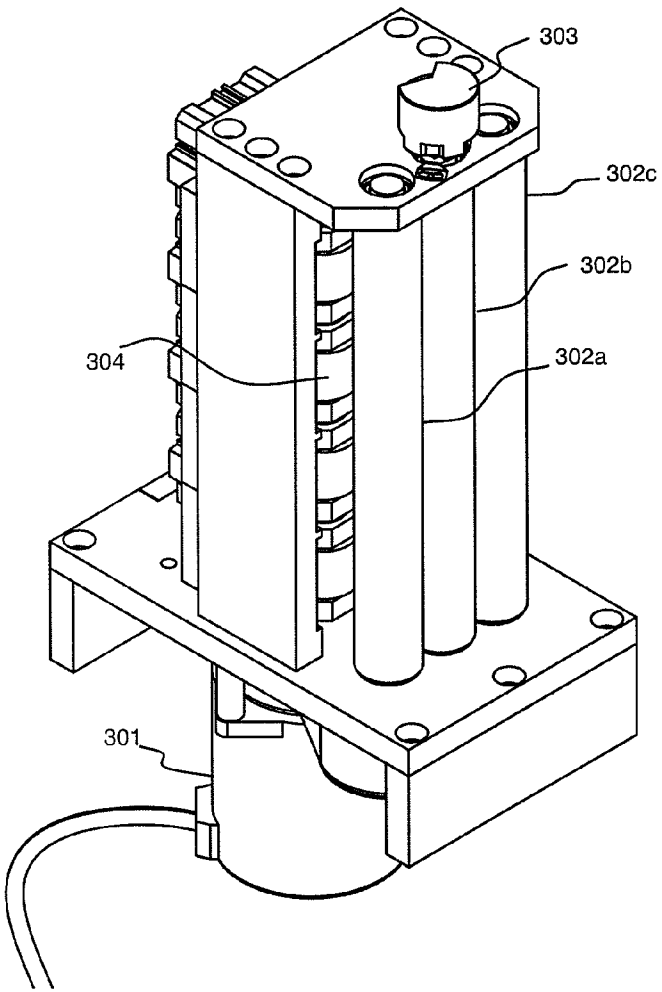
FIGS. 3A-C are diagrams of a feeding unit of a channel letter machine according to an embodiment of the present disclosure.
Figure 3A:
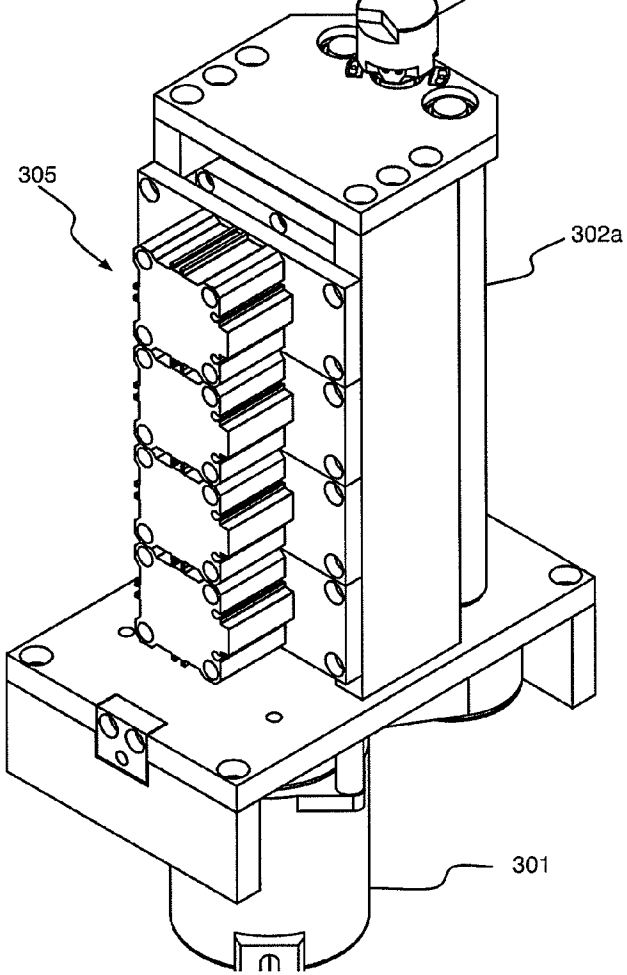
Figure 3C:
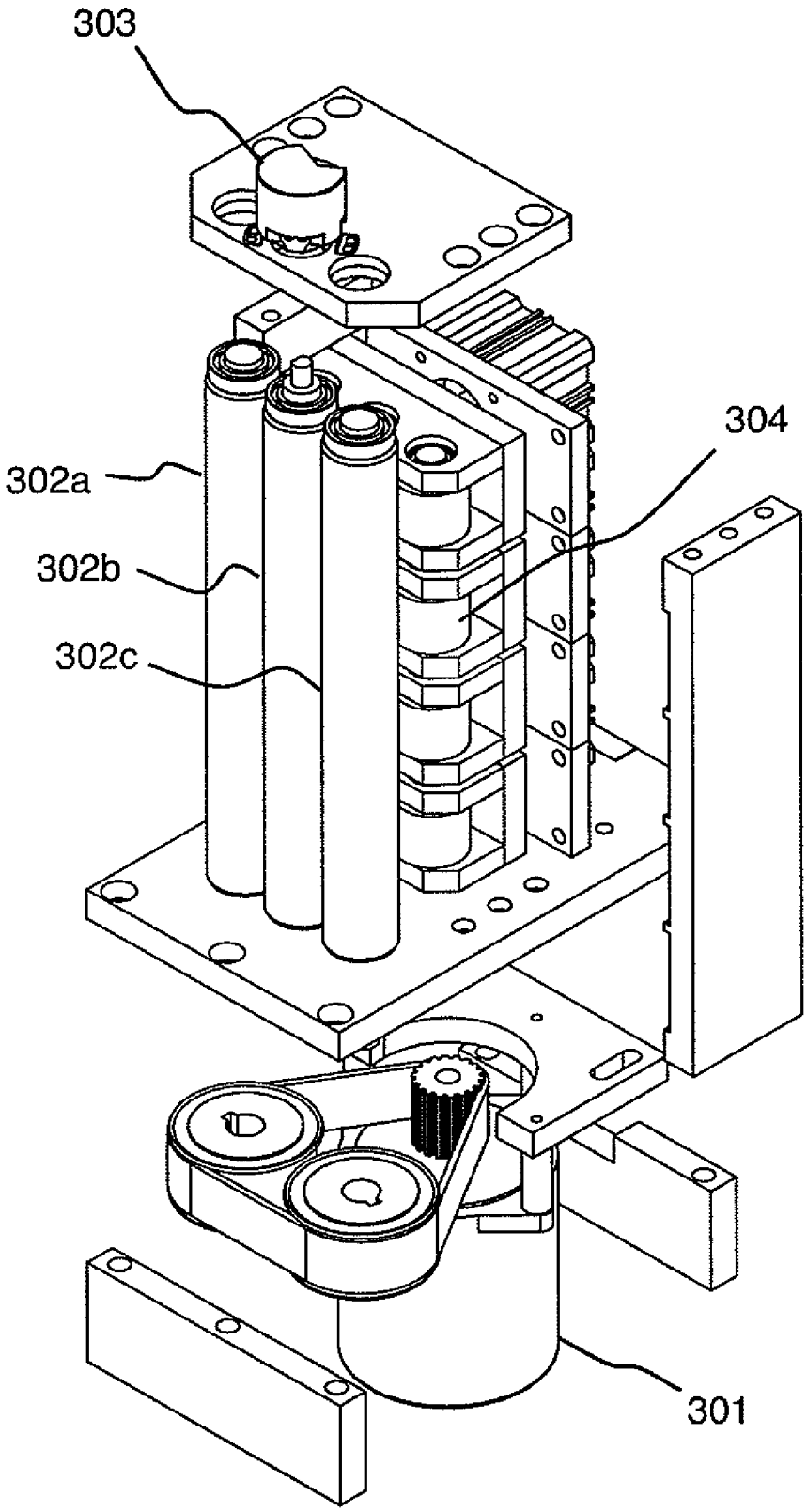
Figure 4D:
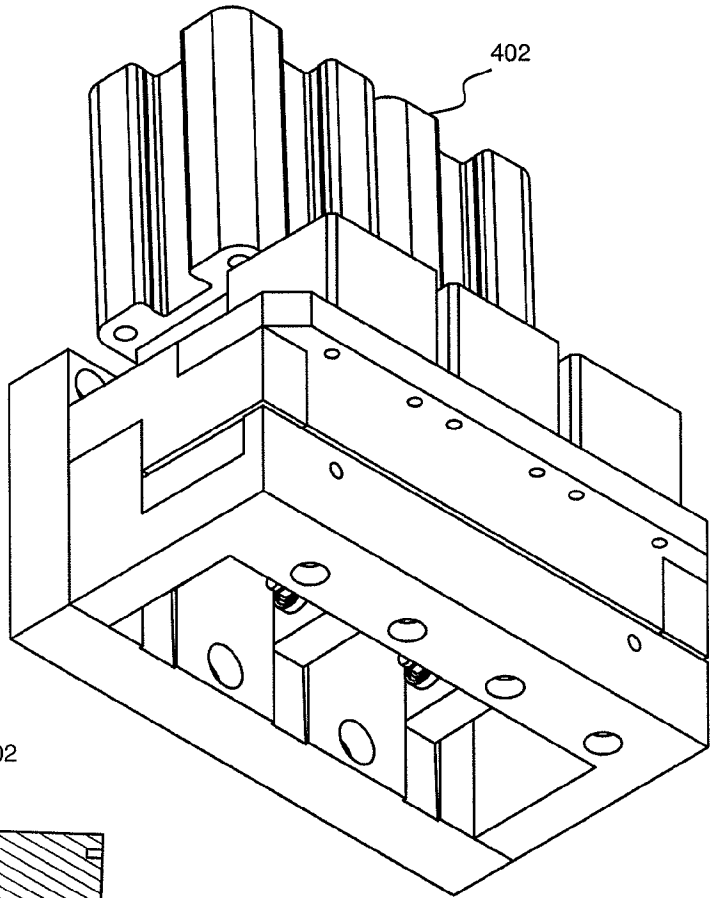
FIGS. 4A-F are diagrams of a flanging unit of a channel letter machine according to an embodiment of the present disclosure.
Figure 4C:
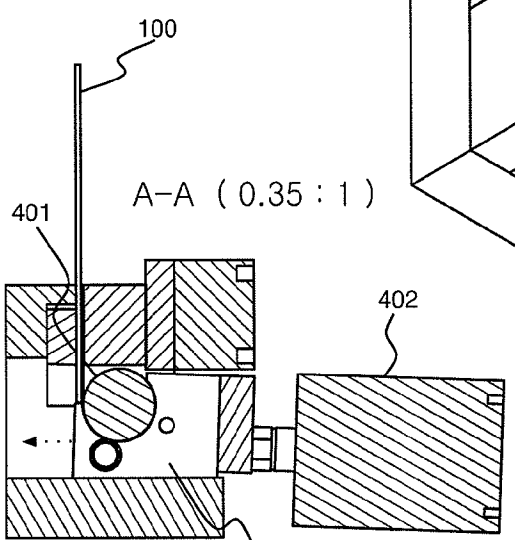
Figure 4A:
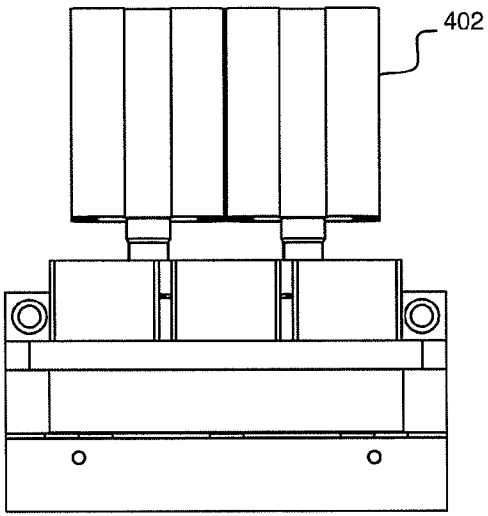
Figure 4B:
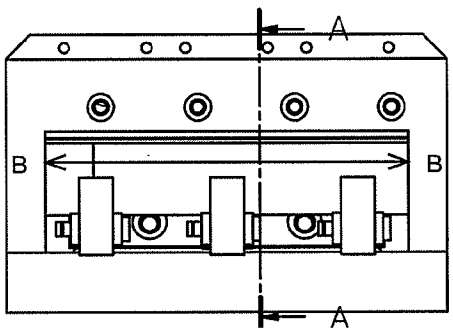
Figure 4F:
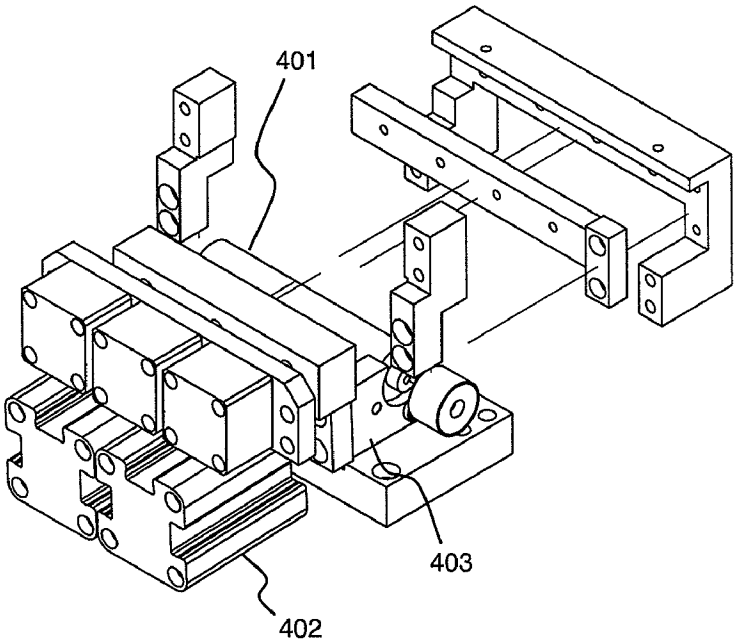
Figure 4E:
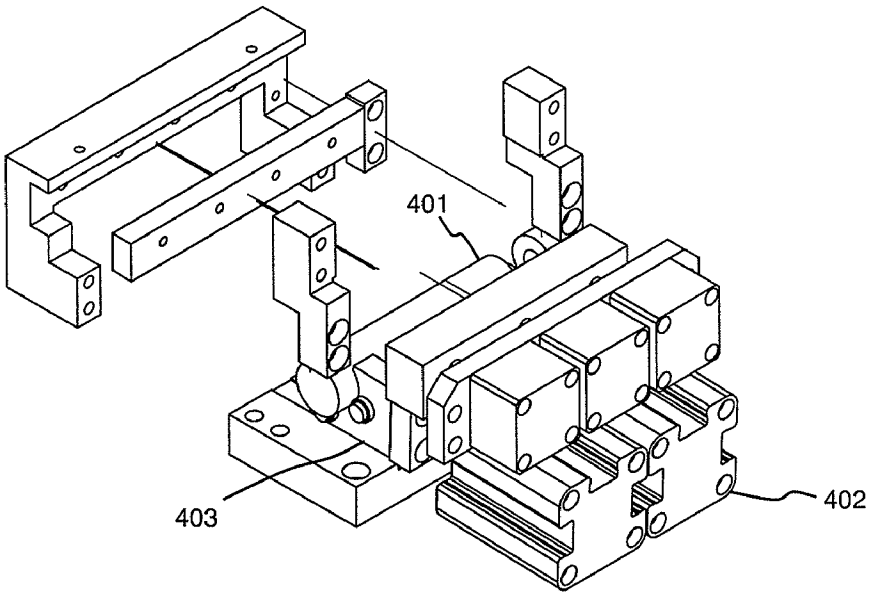

Referring to FIGS. 3A and 3B, the feeding unit 102 includes a feed motor 301, a feed rollers 302*a* and 302*c*, an encoder roller 302*b*, an encoder 303, and counter rollers 304. The feed motor 301 drives the feed rollers 302*a* and 302*c* to pass the stock through the channel letter machine. The feeding unit 102 is height adjustable. The encoder 303 reads an actual advance of the stock according to a rotation of an encoder roller 302*b*, which spins freely. As the stock is passed through the feeding unit 102, the actual advance of the stock is determined. Should there be slippage of the stock against the feed rollers 302*a* and 302*c*, the control computer compensates for the slippage, e.g., by performing flanging, notching, and bending according to the actual advance of the stock, such that flanges, notches and bends are formed at the appropriate positions. A plurality of counter rollers 304, e.g., four, may be engaged by corresponding cylinders 305 according to the height of the stock material. The computer determines and actuates the number of counter rollers 304 to engage according the user's input of stock height. The counter rollers 304 are engaged by moving laterally, to press the stock against the rollers 302*a-c*. The counter rollers 304 apply substantially even pressure across the height of the stock and also the same to the top and bottom of feed unit. A number of counter rollers 304 may be controlled by each cylinder 305, for example, three counter rollers across, opposing the feeding rollers 302*a* and 302*c*, and the encoding roller 302*b*.

Referring to FIGS. 4A-4D, the flanging unit 103 includes a flanging roller 401 and a flanging actuator 402. The flanging actuator 402 is engaged to press the flanging roller 401 against the stock 100 to facilitate forming a flange. The flanging actuator pushes a carrier 403 laterally with respect to a surface of the stock 100 protruding into the flanging unit 103 (see FIG. 4C). The flanging roller 401 is disposed in the carrier 403 and is pressed against the stock 100 forming a flange. The flanging unit 103 cuts the stock 100 at the end positions of the flanges. The edge of the roller 401 works as a cutting tool to cut the flange, such that a flange may have one or more portions having a length equal to or less than a length of the flanging unit shown as B-B in FIG. 4B.

Figure 5D:
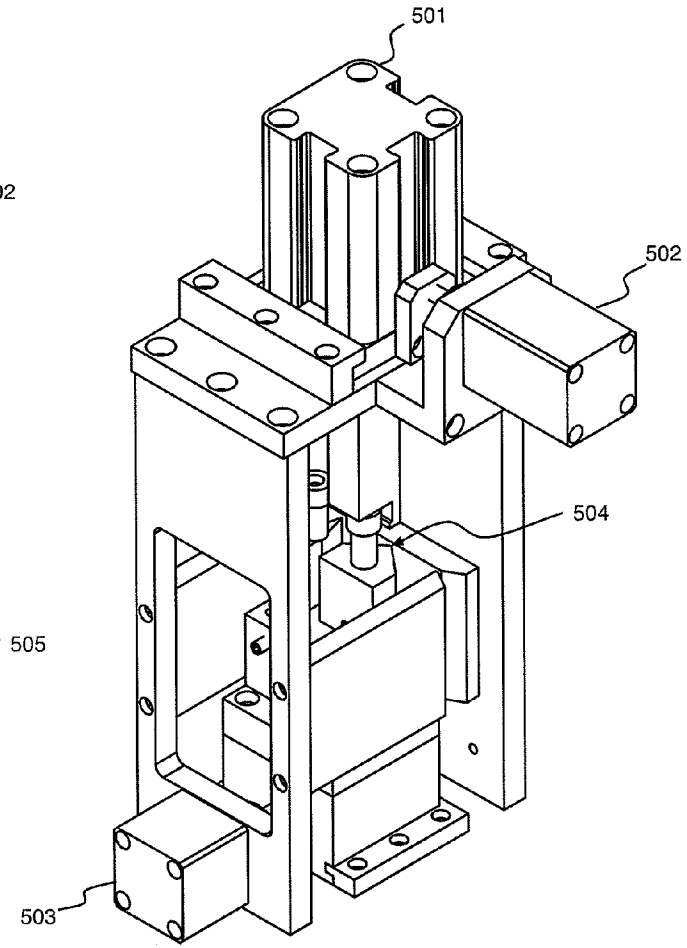
FIGS. 5A-E are diagrams of a notching unit of a channel letter machine according to an embodiment of the present disclosure.
Figure 5C:
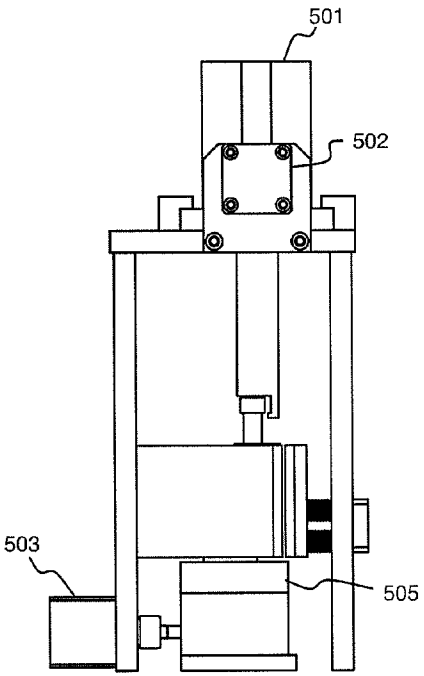
Figure 5A:
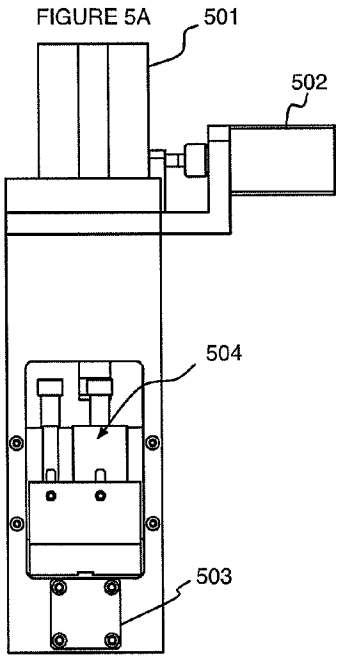
Figure 5B:
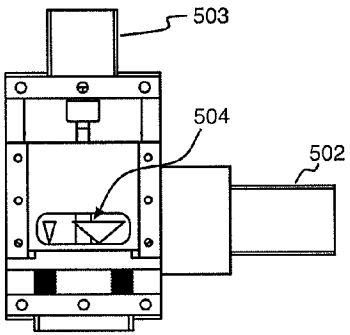
Figure 5E:
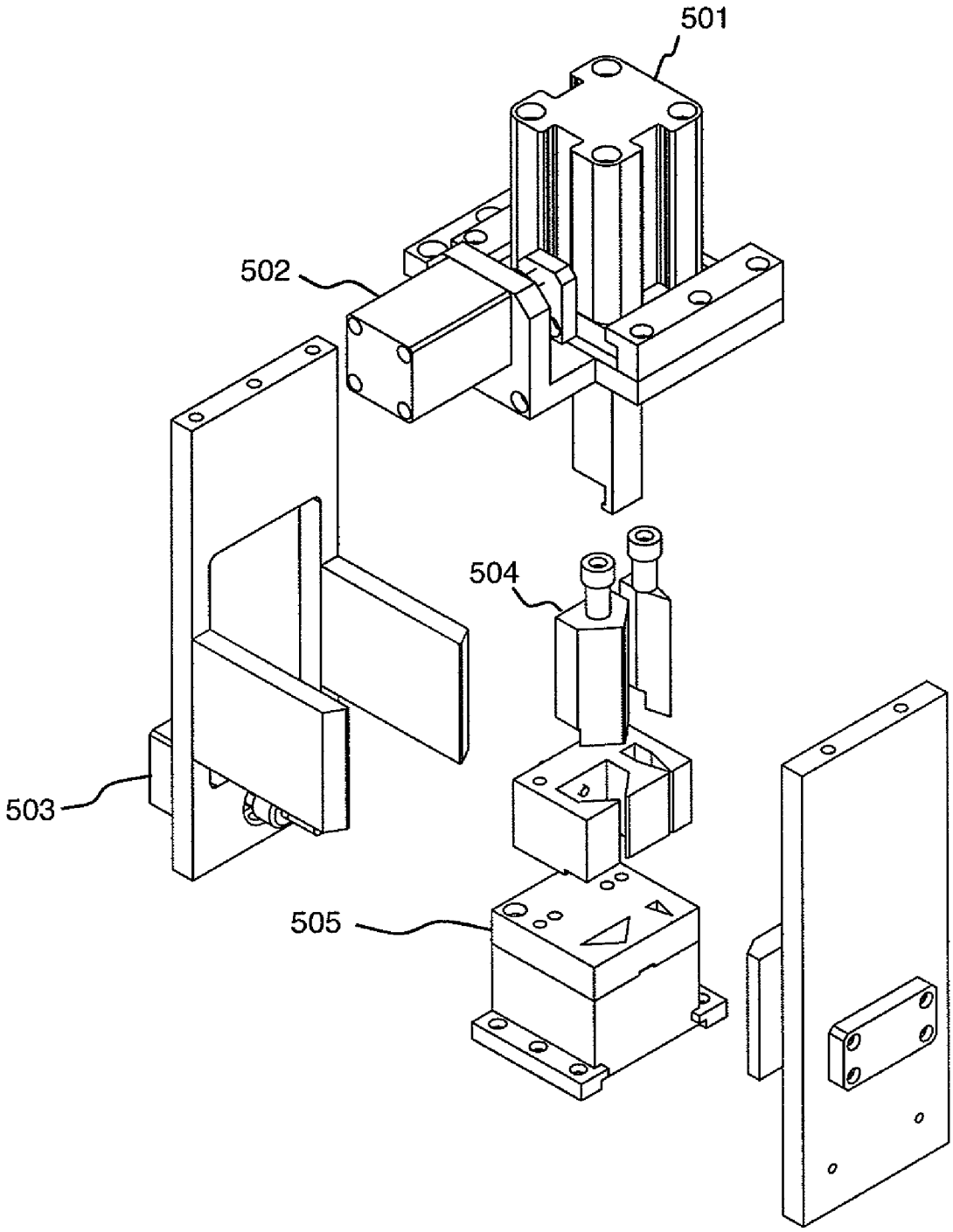

Referring to FIGS. 5A-D, a notching unit 104 includes a notch actuator 501, a notch selector 502, a stock engager 503 and at least one a notch cutter 504. As depicted in FIG. 5B, a bottom view of the notching unit 104, two different sized notch cutters may be implemented. The notch selector 502 selects a notch of a given size according to a desired configuration. The notch actuator 501 engages a selected cutter against a flange of the stock to cut a notch in the flange. The stock engager 503 includes a movable portion 505 that rises to push the stock against an opposite wall holding a flange of the stock firmly in place during the notching operation.

Figure 6C:
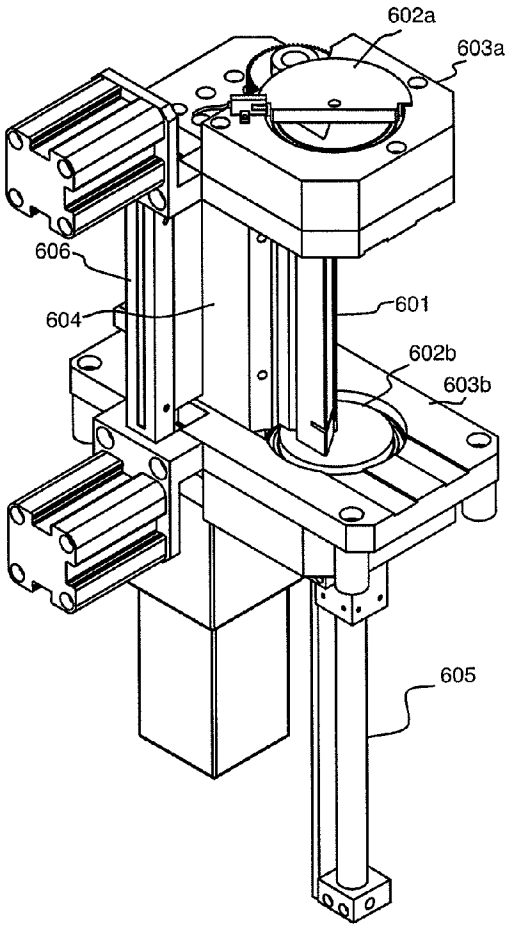
FIGS. 6A-E are diagrams of cutting tool and bending unit of a channel letter machine according to an embodiment of the present disclosure.
Figure 6B:
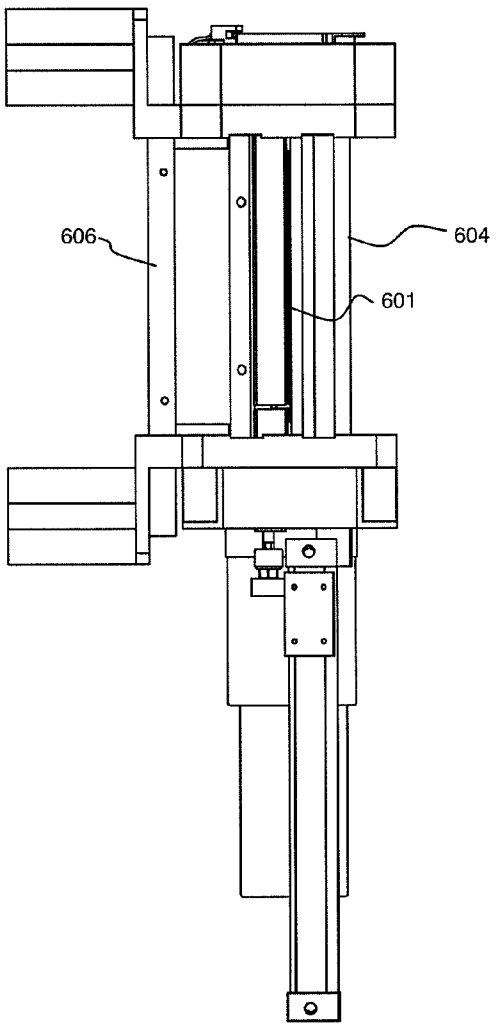
Figure 6A:
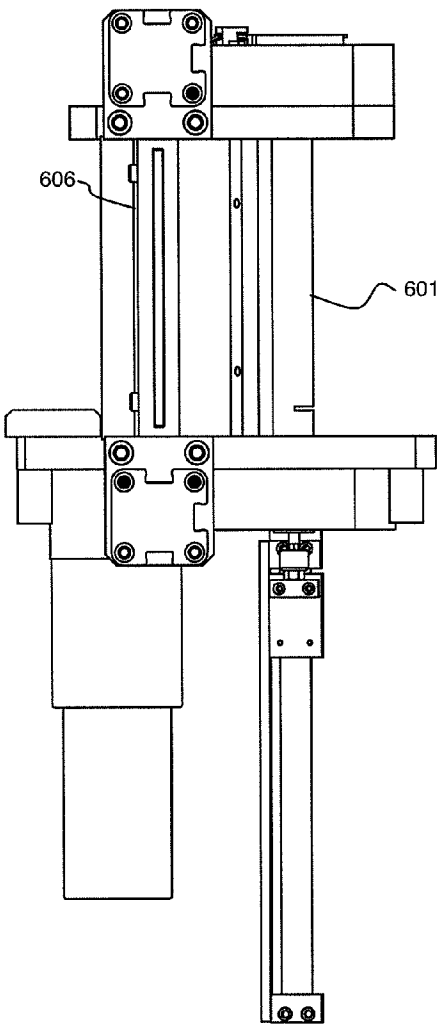
Figure 6D:
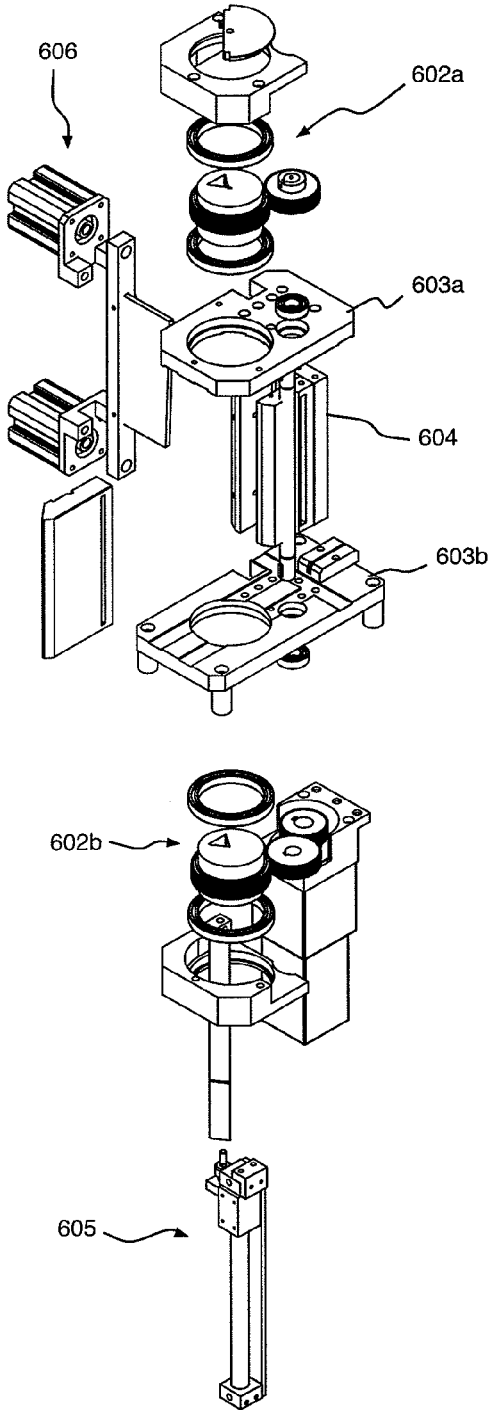
Figure 6E:
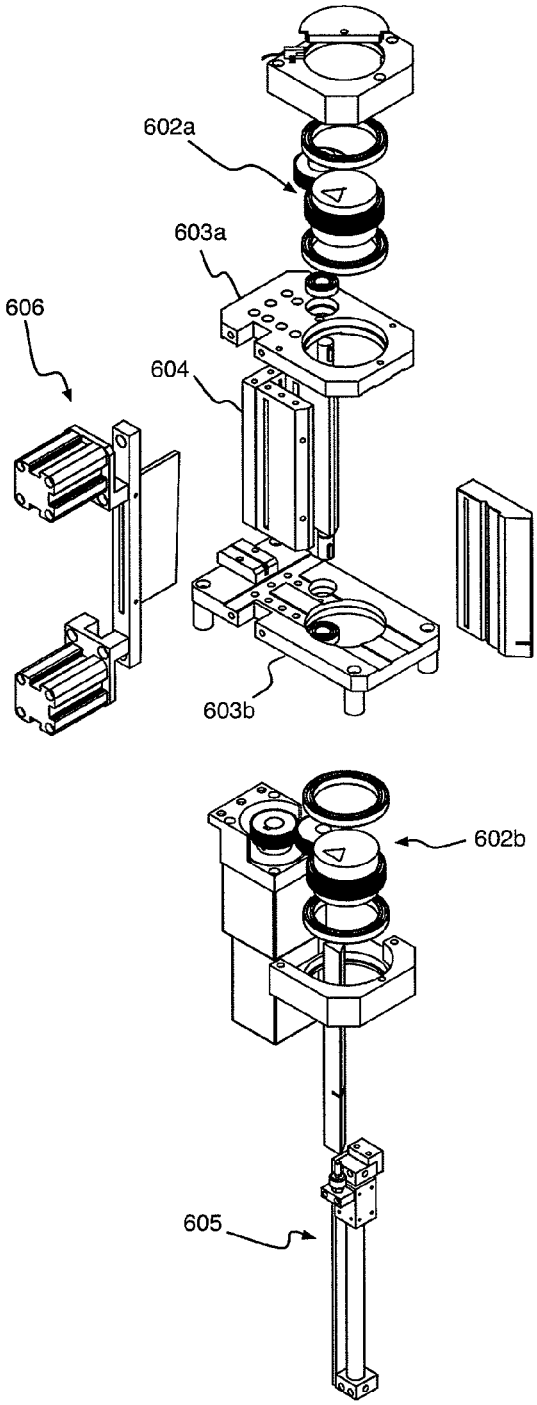

Referring to FIGS. 6A-C, the bending unit 105 comprises a bending finger 601 and rotary bodies 602*a* and 602*b* for rotating the bending finger 601. The rotary bodies 602*a* and 602*b* are set in supporting frames 603*a* and 603*b*. The bending unit 105 includes a bending nozzle 604 of a size through which the stock, including the flanges, can be passed. The bending finger 601 is engaged by a bending finger actuator 605. The bending finger actuator 605 guides the bending finger 601 into place between the rotary bodies 602*a* and 602*b*. The bending finger 601, once disposed between the rotary bodies 602*a* and 602*b* may be rotated by the rotary bodies 602*a* and 602*b* to facilitate the bending function. The bending unit 105 further includes a cutting tool 606 for cutting the stock to a desired length. The cutting tool 606 moves in a direction substantially perpendicular to a plane of the stock, slicing the stock at end positions.

Figure 7:
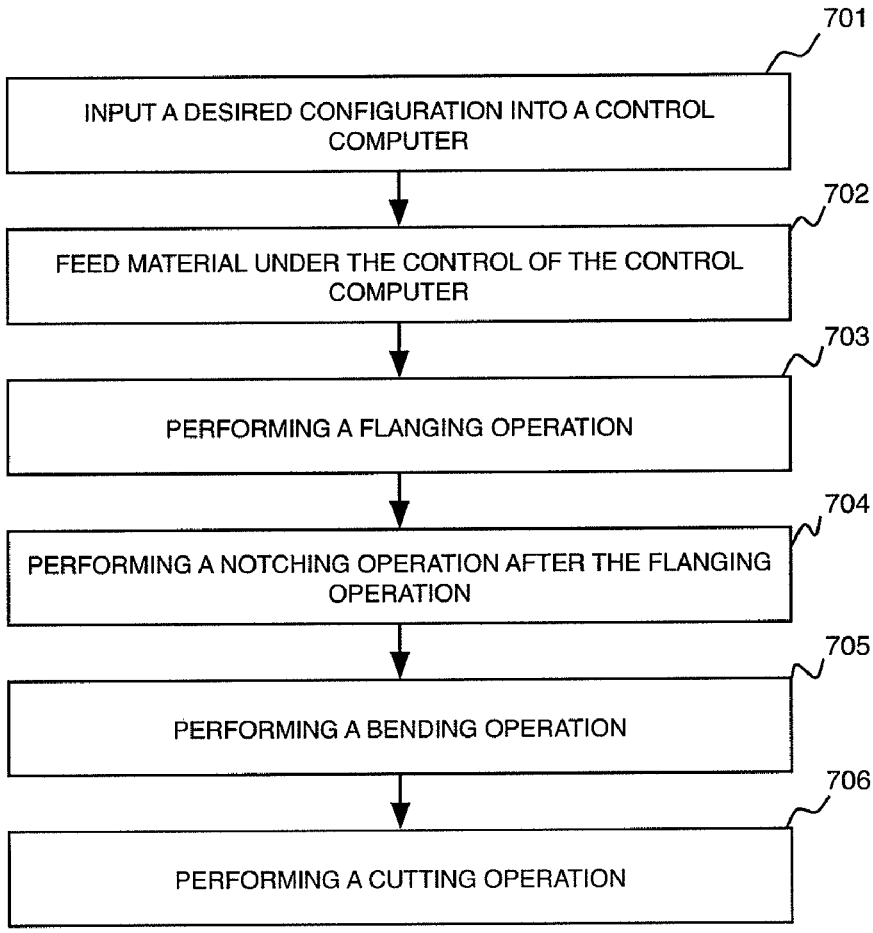
FIG. 7 is a flow chart of a method according to an embodiment of the present disclosure.

Referring to FIG. 7, a method of automatically bending a return of a channel letter includes inputting a desired configuration for the return to be formed into a control computer 701, and feeding a stock under the control of the control computer 702 along a feed path including a flanging unit, a notching unit, and a bending unit that are arranged along the feed path for the stock, with the flanging unit being located upstream of the notching unit and the bending unit along the feed path. The method further includes forming the flange on the bottom of the stock at desired flange positions on the stock at the flanging unit under the control of the control computer 703, notching a flange of the stock at locations corresponding to a position of bends at the notching unit under the control of the control computer 704, and bending the stock at the positions of the bends into the desired configuration for the return at the bending unit under the control of the control computer 705. The stock may be cut at a cutting unit of the bending unit 706.

Each of a feeding operation, a flanging operation, a notching operation, and a bending operation are performed according to an input, e.g., inputs from a computer or user commands. According to the input a return may be formed without a flange, without a notch, and/or without a bend.

Figure 8:
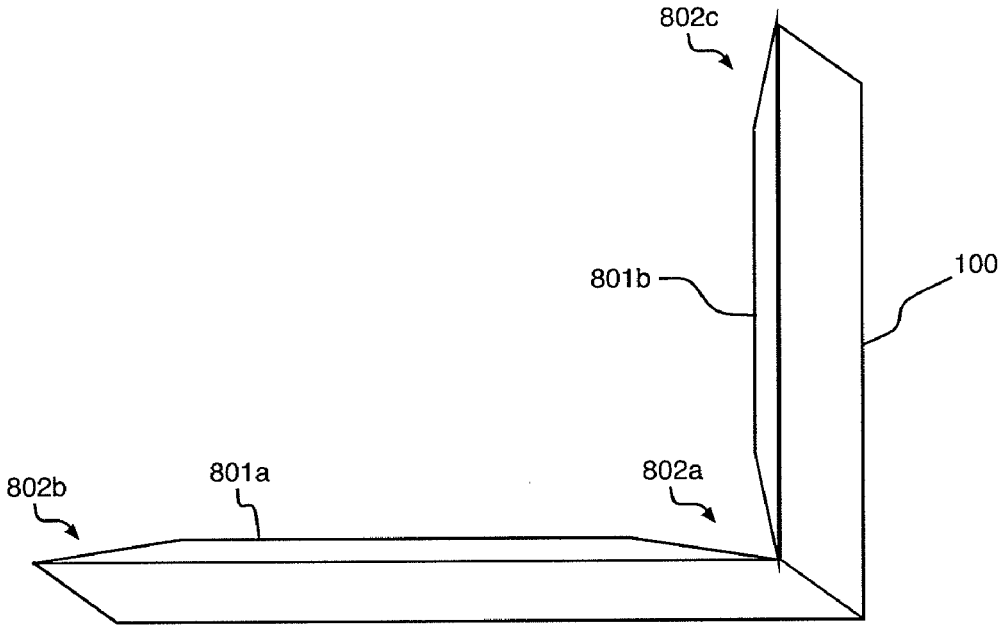
FIG. 8 is an illustration of a portion of a return of a channel letter.

FIG. 8 depicts an exemplary stock 100, having flanges 801*a-b*, and notches 802*a-c*.

The control computer of the may be implemented in various forms of hardware, software, firmware, special purpose processors, or a combination thereof. In one embodiment, user commands may be implemented by software such as an application program tangibly embodied on a program storage device. The application program may be uploaded to, and executed by, a machine comprising any suitable architecture.

The control computer can comprise, inter alia, a central processing unit (CPU), a memory and an input/output (I/O) interface. The computer system is coupled through the I/O interface to the feeding unit 102, the flanging unit 103, the notching unit 104 and the bending unit 105. The computer system may include various input devices such as a mouse and keyboard. User commands may be processed by a routine that is stored in memory and executed by the CPU. As such, the computer system is a general purpose computer system that becomes a specific purpose computer system when executing the routine.

It is to be further understood that, because some of the constituent system components and method steps depicted in the accompanying figures may be implemented in software, the actual connections between the system components (or the process steps) may differ depending upon the manner in which the present invention is programmed. Given the teachings of the present invention provided herein, one of ordinary skill in the related art will be able to contemplate these and similar implementations or configurations of the present invention.

Having described embodiments for a system and method for a channel letter machine used for manufacturing a predetermined design from sheet material, it is noted that modifications and variations can be made by persons skilled in the art in light of the above teachings. It is therefore to be understood that changes may be made in embodiments of the present disclosure that are within the scope and spirit thereof.

What is claimed is:

1. A non-transitory computer readable medium embodying instructions executable by a processor to perform a method of automatically bending a return of a channel letter, the method comprising:

inputting a desired configuration for the return to be formed into a control computer;

feeding a stock under the control of the control computer along a feed path including an encoder, a flanging unit, a notching unit, and a bending unit that are arranged along the feed path for the stock, with the flanging unit being located downstream of the encoder and upstream of the notching unit and the bending unit along the feed path;

forming selectively a flange on the bottom of the stock at desired flange positions on the stock at the flanging unit under the control of the control computer, wherein the method further comprises setting a height of at least one guide for controlling a depth of the flange, wherein the guide supports a bottom edge of the stock controlling a height of the stock relative to the flanging unit;

notching the flange of the stock at locations corresponding to a position of bends at the notching unit under the control of the control computer; and bending the stock at the positions of the bends into the desired configuration for the return at the bending unit under the control of the control computer.

2. The computer readable medium of claim 1, wherein the method further comprises cutting the stock at a cutting unit.

3. The computer readable medium of claim 1, wherein feeding the stock under the control of the control computer further comprises:

determining an amount of stock passing the encoder; and performing at least one of the steps of forming the flange, notching the flange, and bending the stock according to the amount of stock passing the encoder.

4. The computer readable medium of claim 1, wherein forming the flange further comprises simultaneously cutting the flange.

5. A non-transitory computer readable medium embodying instructions executable by a processor to perform a method of automatically bending a return of a channel letter, the method comprising: inputting a desired configuration for the return to be formed into a control computer; feeding a stock under the control of the control computer along a feed path including an encoder, a flanging unit, a notching unit, and a bending unit that are arranged along the feed path for the stock, with the flanging unit being located downstream of the encoder and upstream of the notching unit and the bending unit along the feed path; forming selectively a flange on the bottom of the stock at desired flange positions on the stock at the flanging unit under the control of the control computer; notching the flange of the stock at locations corresponding to a position of bends at the notching unit under the control of the control computer; and bending the stock at the positions of the bends into the desired configuration for the return at the bending unit under the control of the control computer; wherein forming the flange further comprises simultaneously cutting the flange.

* * * * *